US008479809B2

(12) United States Patent
Farquhar

(10) Patent No.: US 8,479,809 B2
(45) Date of Patent: Jul. 9, 2013

(54) ANTI-EXTRUSION BACKUP SYSTEM, PACKING ELEMENT SYSTEM HAVING BACKUP SYSTEM, AND METHOD

(75) Inventor: Graham E. Farquhar, Turriff (GB)

(73) Assignee: Baker Hughes Incorporated, Houston, TX (US)

( * ) Notice: Subject to any disclaimer, the term of this patent is extended or adjusted under 35 U.S.C. 154(b) by 299 days.

(21) Appl. No.: 12/956,781

(22) Filed: Nov. 30, 2010

(65) Prior Publication Data

US 2012/0133098 A1 May 31, 2012

(51) Int. Cl.
*E21B 33/12* (2006.01)
*E21B 33/03* (2006.01)
*E21B 33/128* (2006.01)

(52) U.S. Cl.
USPC ..... 166/196; 166/387; 277/328; 277/337

(58) Field of Classification Search
USPC ..... 277/328, 336–340; 166/196, 387
See application file for complete search history.

(56) References Cited

U.S. PATENT DOCUMENTS 3,706,342 A * 12/1972 Woolley ..... 277/340
4,151,875 A * 5/1979 Sullaway ..... 166/126
4,441,552 A * 4/1984 Hamman ..... 166/133
4,665,978 A * 5/1987 Luke ..... 277/340
4,765,404 A * 8/1988 Bailey et al. ..... 166/117.6
5,224,540 A * 7/1993 Streich et al. ..... 166/118
5,678,635 A * 10/1997 Dunlap et al. ..... 166/387
7,708,080 B2 * 5/2010 Conaway et al. ..... 166/387
2004/0069502 A1 * 4/2004 Luke ..... 166/387
2006/0219415 A1 * 10/2006 Xu ..... 166/387
2008/0060821 A1 3/2008 Smith et al.

OTHER PUBLICATIONS

Chapman et al. "Wireline Deployed Metal Sealing Bridge Plug System: Operational Learning Curve and Subsequent Redevelopment." SPE/ICoTA Coiled Tubing and Well Intervention Conference and Exhibition, Apr. 1-2, 2008, The Woodlands, Texas, USA. [Abstract and Introduction Only].

Mackenzie, Gordona and Garry Garfield. "Wellbore Isolation Intervention Devices Utilizing a Metal-to-Metal Rather Than an Elastomeric Sealing Methodology." SPE Annual Technical Conference and Exhibition, Nov. 11-14, 2007, Anaheim, California, U.S.A. [Abstract Only].

Mody, R.K. and M.P. Coronado, "New Generation Inflatable Packing Elements." Offshore Technology Conference, May 6-May 9, 1991, Houston, Texas. [Abstract and Introduction Only].

International Search Report and Written Opinion; Date of Mailing 15 Ay 2012; International Application No. PCT/US2011/059767; Korean Intellecutal Property Office; International Searc Report 5 pages; Written Opinion 4 pages.

* cited by examiner

*Primary Examiner* — Vishal Patel
*Assistant Examiner* — Nicholas L Foster
(74) *Attorney, Agent, or Firm* — Cantor Colburn LLP

(57) ABSTRACT

An antiextrusion backup system includes an inner expandable backup ring having a first set of slots. An outer expandable backup ring having a second set of slots wherein the outer expandable back up ring is rotationally locked to the inner expandable backup ring to prevent an extrusion gap in an expanded condition of the backup rings. A method for operating within a tubular is also included.

27 Claims, 3 Drawing Sheets

ANTI-EXTRUSION BACKUP SYSTEM, PACKING ELEMENT SYSTEM HAVING BACKUP SYSTEM, AND METHOD

BACKGROUND

In the downhole drilling and completion industry, elastomeric seals are used to seal annular areas between concentric tubulars. Extrusion of such seals is a well known issue in the downhole industry for which many solutions have been proposed. In view of the endless number of potential specific applications however, the art is always in search of additional methodologies and configurations to combat extrusion.

BRIEF DESCRIPTION

An antiextrusion backup system includes an inner expandable backup ring having a first set of slots; and an outer expandable backup ring having a second set of slots, wherein the outer expandable back up ring is rotationally locked to the inner expandable backup ring to prevent an extrusion gap in an expanded condition of the backup rings.

A packing element system includes first and second sets of backup rings, each set of backup rings including an inner expandable backup ring having a first set of slots; and an outer expandable backup ring having a second set of slots, wherein the outer expandable back up ring is rotationally locked to the inner expandable backup ring to prevent an extrusion gap in an expanded condition of the backup rings; and a deformable element positioned between the first and second sets of backup rings.

A method for operating within a tubular, the method includes compressing a packing element system, the system including first and second sets of backup rings, each set of backup rings including an inner expandable backup ring having a first set of slots and an outer expandable backup ring having a second set of slots, the outer expandable back up ring rotationally locked to the inner expandable backup ring, and a deformable element positioned between the first and second sets of backup rings; deforming the deformable element into contact with an inner surface of the tubular; engaging the first and second sets of backup rings with the inner surface of the tubular by expanding the first and second sets of backup rings; and preventing extrusion of the deformable element through the backup rings by overlapping the slots of the inner backup rings with flanges of the outer backup rings and flanges of the inner backup rings with the slots of the outer backup rings.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
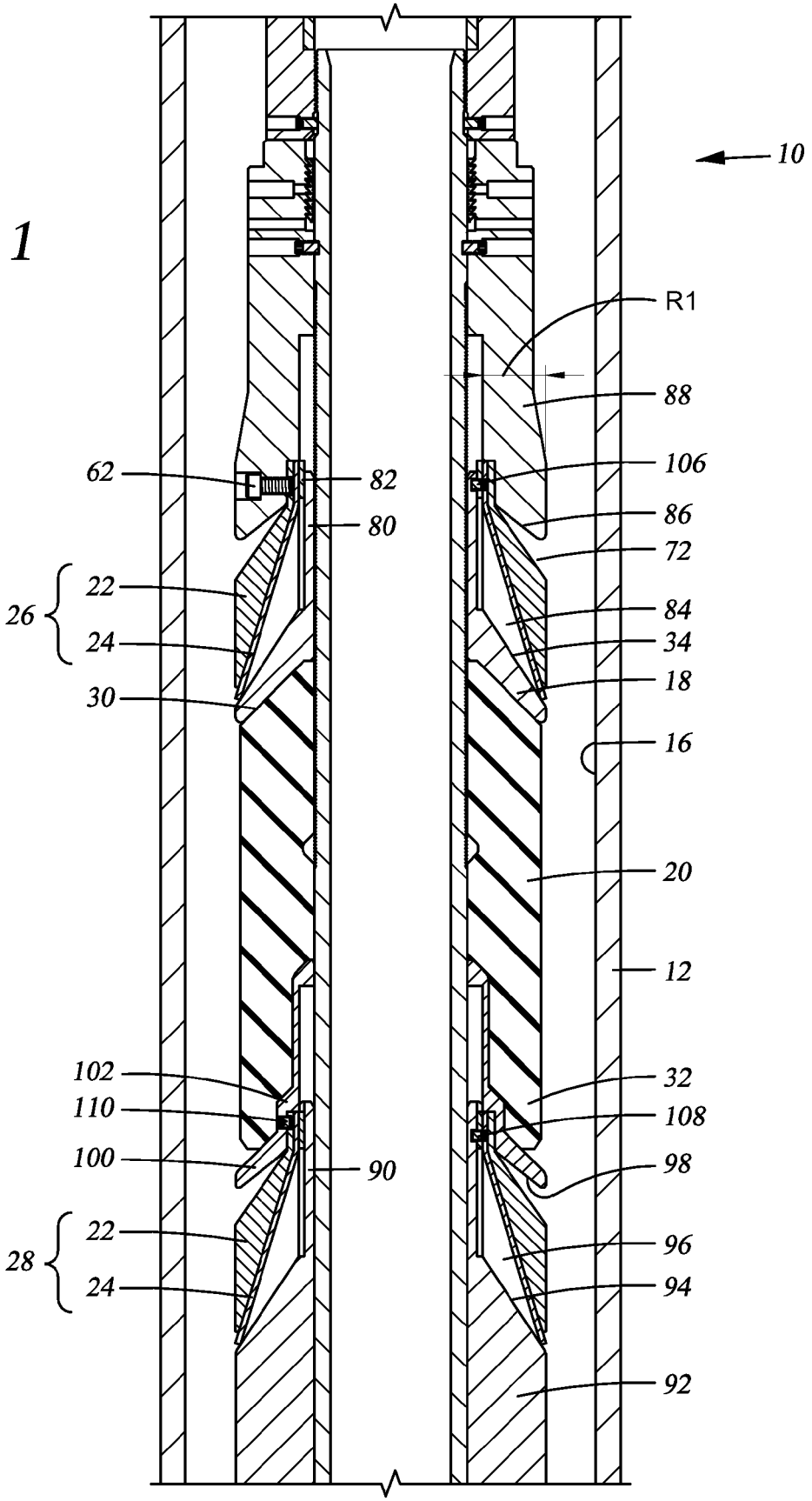
FIG. 1 depicts a cross sectional view of a packing element system in an unsealed condition.
Figure 2:
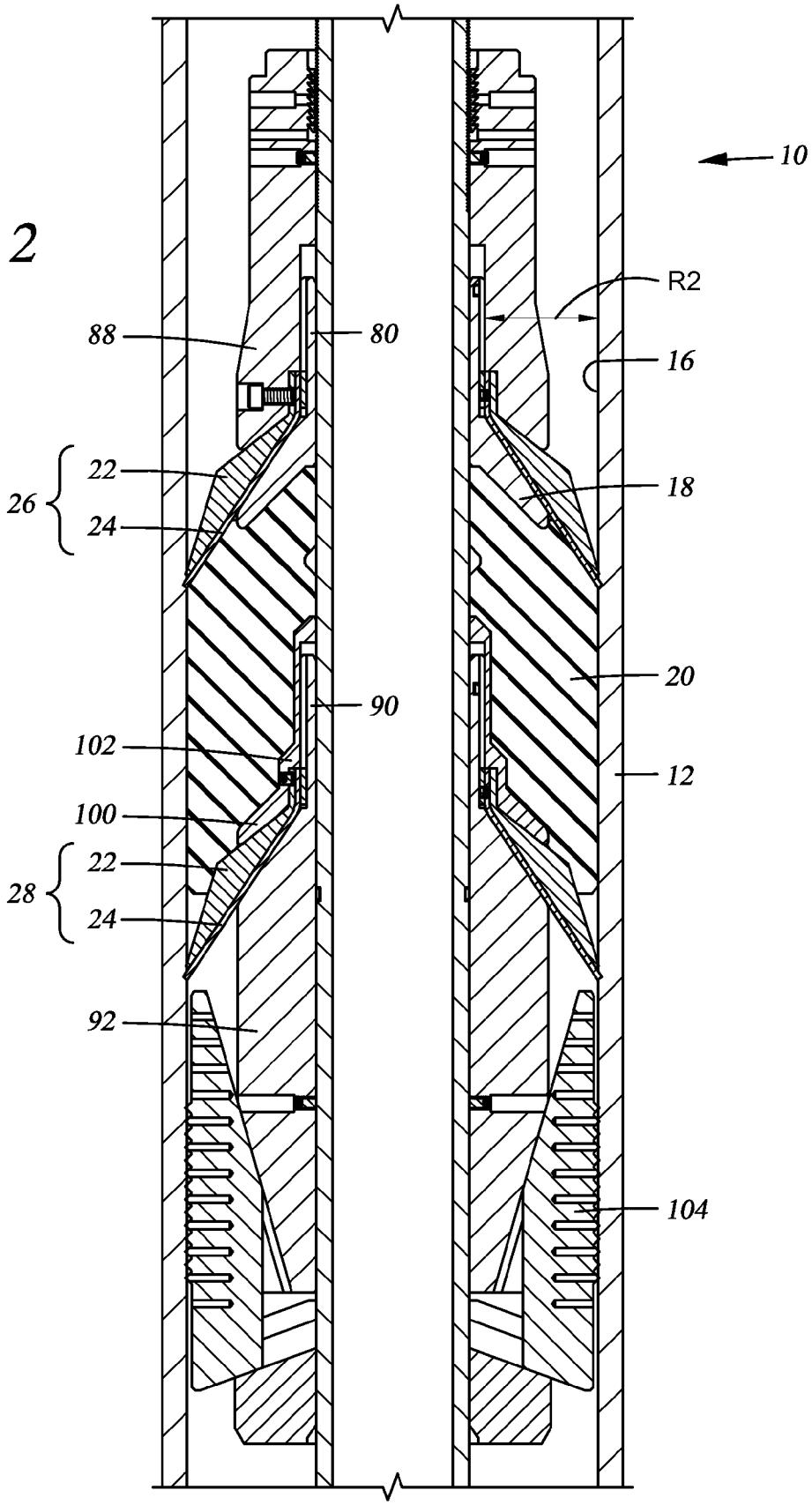
FIG. 2 depicts a cross sectional view of a packing element system in a sealed condition.

Referring to FIGS. 1 and 2, a cross section of a permanent or retrievable packing element system 10 is shown which may be employed as a downhole packer, a plug, a cement retainer, or similar annular sealing configuration. The packing element system 10 is shown in an unset or retracted condition in FIG. 1 and in a set condition in FIG. 2. The tubular of the packing element system 10 is illustrated in cross section within another tubular structure 12 such as a casing segment. In the unset condition shown in FIG. 1, a clearance 14 exists between an inside surface 16 of the tubular structure 12 and a first petal support 18. The clearance 14 is taken up by packing element 20 when the packing element system 10 is compressed as shown in FIG. 2. In an exemplary embodiment, the packing element 20 is a deformable element, such as, but not limited to, a composite single piece element with vulcanized ends to provide increased extrusion resistance on a softer center element section.

Extrusion of the element 20 is prevented by backup rings including an outer expandable backup ring 22 and an inner expandable backup ring 24. The rings 22 and 24 are expandable to occupy the clearance 14 to prevent the element 20 from extruding in the direction of the backup rings 22 and 24. In the illustrated embodiment, a first area 30 of the element 20 is adjacent a first set of backup rings 26 and a second area 32 of the element 20 is adjacent a second set of backup rings 28 such that the element 20 cannot extrude in either axial direction when the backup rings 26, 28 are actuated to be expanded as shown in FIG. 2.

Figure 3:
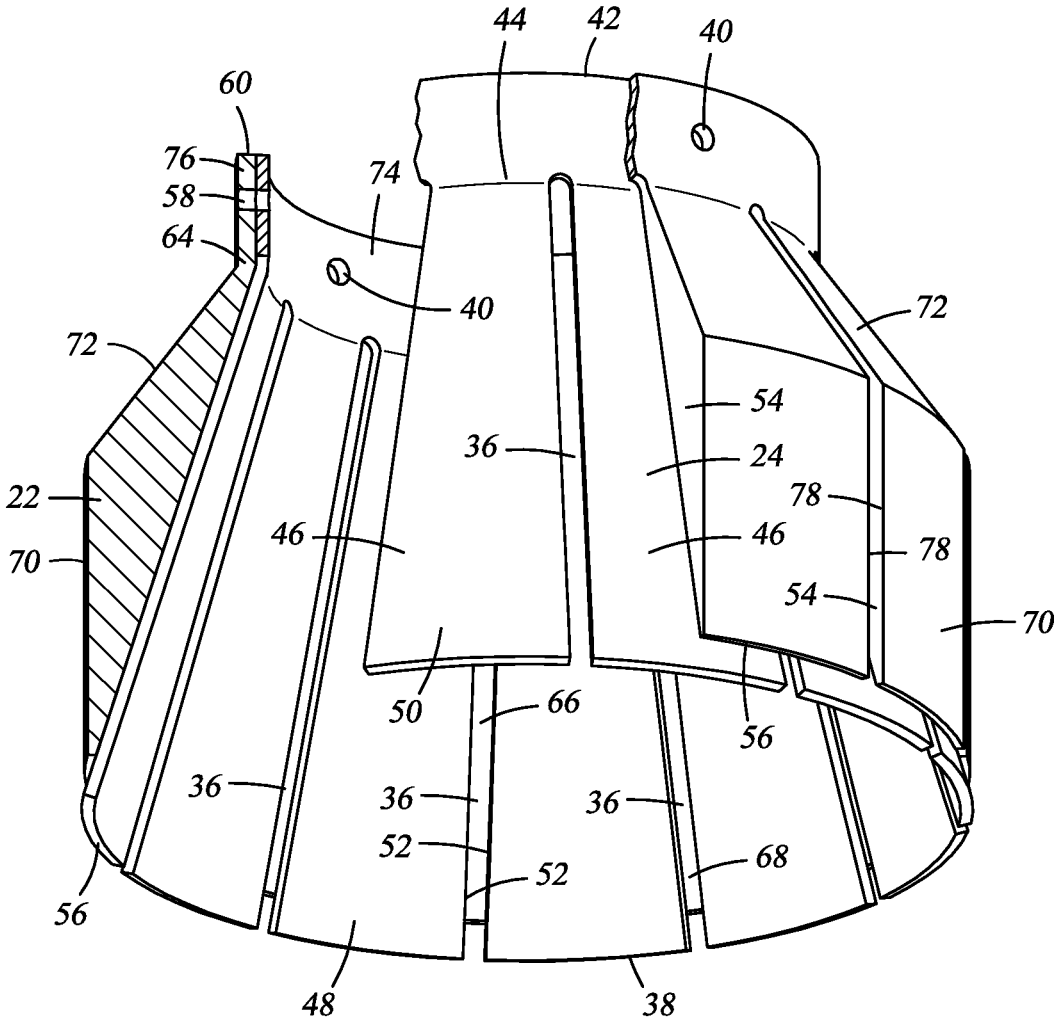
FIG. 3 depicts a perspective and cutaway view of a set of backup rings as disclosed herein.

FIG. 3 illustrates a perspective view of the inner expandable backup ring 24 and a cutaway view of the outer expandable backup ring 22 to show the inner expandable backup ring 24 nested therein. The inner expandable backup ring 24 includes a first set of slots 36 extending from a first end 38 of the inner expandable backup ring 24. A screw hole or other keying feature 40 is provided adjacent a second end 42 of the inner expandable backup ring 24. A hinge area 44 of the inner expandable backup ring 24 is provided between the first and second ends 38, 42. The first set of slots 36 divide the inner expandable backup ring 24 into a plurality of first flanges 46 having an inner surface 48 and an outer surface 50. The first flanges 46 are bendable at the hinge area 44. Edges 52 of adjacent first flanges 46 may be separated from each other at the first end 38 of the inner expandable backup ring 24 by a first distance in a first instance or unset condition and by a second distance in a second instance or set condition,[mhh1] where the second distance becomes increasingly greater than the first distance as the first flanges 46 flare out. In an alternative exemplary embodiment, the first flanges 46 may not be separated in the unset condition, but may instead contact each other or overlap each other in a first instance or unset condition, and then may become less overlapped or separated in a second instance or set condition. The flange area of the inner expandable backup ring 24, from the hinge area 44 to the first end 38, has a substantially frusto-conical shape that has a larger radial dimension at the first end 38 in the set or expanded condition than in the unset or retracted condition. A non-expanding portion 74 of the inner expandable backup ring 24 is provided between the hinge area 44 and the second end 42, and the non-expanding portion 74 accommodates the keying feature 40.

Also as shown in FIG. 3, the outer expandable backup ring 22 includes a second set of slots 54 extending from a first end 56 of the outer expandable backup ring 22. A screw hole or other keying feature 58 is provided adjacent a second end 60 of the outer expandable backup ring 22 such that the outer expandable backup ring 22 may be rotationally locked or keyed to the inner expandable backup ring 24 such as by a screw 62. A hinge area 64 of the outer expandable backup ring 22 is provided between the first and second ends 56, 60. The second set of slots 54 divide the outer expandable backup ring 22 into a plurality of second flanges 66 having an inner surface 68 and outer surfaces 70, 72. The second flanges 66 are bendable at the hinge area 64. A non-expanding portion 76 of the outer expandable backup ring 22 is provided between the hinge area 64 and the second end 60, and the non-expanding portion 76 accommodates the keying feature 58. In an exemplary embodiment, the second flanges 66 of the outer expandable backup ring 22 may have a substantially triangular cross-section providing additional strength to the backup ring 22. In other exemplary embodiments, the second flanges 66 may be rounded or thickened to provide rigidity, although other cross-sections of the second flanges 66 are also within the scope of these embodiments. In a case where the second flanges 66 are provided with a substantially triangular cross-section, the backup ring 22 has a substantially cylindrical cross-section along the outer surface 70 in the unset condition, and the outer surface 70 of the second flange 66 is within a substantially constant distance from inside surface 16 of the casing 12 during the unset condition. In an exemplary embodiment, the substantially constant distance between outer surface 70 and the inside surface 16 in the unset condition is substantially the same as clearance 14, thus assisting in the insertion and retraction of the system 10 within the casing 12. Edges 78 of adjacent second flanges 66 may be separated from each other at the first end 56 of the outer expandable backup ring 22 by a first distance in an unset condition and by a second distance in a set condition, and the second distance becomes increasingly greater than the first distance as the second flanges 66 flare out. In an exemplary embodiment, the second distance is not greater than a width of the first flanges 46 so as to prevent extrusion of the element 20 past the backup rings 22 and 24. Likewise, the second distance between the edges 52 of adjacent first flanges 46 in a set condition is not greater than a width of the second flanges 66 so as to prevent extrusion of the element 20 past the backup rings 22 and 24. In an alternative exemplary embodiment, the second flanges 66 may not be separated in the unset condition, but may instead contact each other or overlap each other in a first instance or unset condition, and then may become less overlapped or separated in a second instance or set condition.

Inner surfaces 68 of the second flanges 66 make contact with outer surfaces 50 of the first flanges 46. In an exemplary embodiment where the first and second slots 36, 54 separate the first and second flanges 46, 66, respectively, the second slots 54 overlap the first flanges 46, and the first slots 36 are overlapped by the second flanges 66 to ensure that no extrusion gap exists between the backup rings 22 and 24 following expansion. The multiple first and second slots 36, 54 enable expansion with minimal force. The actual number and size of slots 26, 54 and flanges 46, 66 in each of the rings 22, 24 are variable based on design requirements. The inner and outer backup rings 24, 22 may be substantially the same for the first and second sets of backup rings 26, 28. However, the inner and outer backup rings 24, 22 in the first and second sets of backup rings 26, 28 may include modified keying features for engagement with their respective adjacent structures.

With reference again to FIGS. 1 and 2, in order to actuate the backup rings 22 and 24, a number of other components of the system 10 are utilized including uphole components of the system 10 in the uphole direction of backup rings 26, and downhole components of the system 10 in the downhole direction of backup rings 28. The petal support 18 includes a ramp surface 34 that interacts with the inner surface 48 of the inner expandable backup ring 24 in the first set of backup rings 26 during axial compression of the system 10 to cause the first set of backup rings 26 to expand from a first radial dimension R1 shown in FIG. 1 to a second radial dimension R2 shown in FIG. 2, where R2 is greater than R1. The expansion of the backup rings 22 and 24 spans the entirety, in one embodiment, or at least a substantial portion of, in other embodiments, the clearance 14. In an exemplary embodiment, R2 is substantially equal to R1 plus the distance defined by clearance 14.

In FIG. 1, prior to expansion of the backup rings 22 and 24, the non-expanding portion 74 of the inner backup ring 24 is adjacent to a sleeve portion 80 of the first petal support 18. In an exemplary embodiment, the sleeve portion 80 of the first petal support 18 is fitted within the inner backup ring 24 and rotationally locked thereto by a rotational lock tab 82, although the inner backup ring 24 is still axially movable with respect to the first petal support 18. A space 84 is formed between the inner surface 48 of the first flanges 46 of the inner backup ring 24 and the first petal support 18. As the backup rings 26 expand, the nonexpanding portions 74, 76 of the backup rings 26 slide relative to the petal support 18, moving along the sleeve portion 80, while the first flanges 46 of the inner backup ring 24 make contact with and ramp up the ramp surface 34 of the first petal support 18. The flanges 46, 66 of the backup rings 26 are able to expand past an outer dimension of the first petal support 18 until the hinge area 44 contacts ramp surface 34 and the space 84 is completely taken up by the backup rings 26 as shown in FIG. 2, with the first flanges 46 of the inner backup ring 24 supported by the ramp surface 34 of the first petal support 18 and the second flanges 66 of the outer backup ring 22 supported on the first flanges 46 of the inner backup ring 24. Additionally, angled surface 86 of body 88 makes face to face contact with outer surface 72 of the second flanges 66 of the outer expandable ring 22, such that the rings 22, 24 are supported by contact faces to resist forces that are applied during pressure testing above and below the packing element 20.

Similarly, backup rings 28 may slide relative to a sleeve portion 90 of ramp body 92 on the opposite side of the element 20. The first flanges 46 of the inner backup ring 24 ramp up ramp surface 94 of the ramp body 92 until space 96 is taken up by the backup rings 28. Second flanges 66 of the outer expandable backup ring 22 abut and are supported by angled surface 98 of second petal support 100 to fully support the backup rings 28. In one exemplary embodiment, it should be noted that the second petal support 100 for the backup rings 28 is modified to accommodate downwardly facing backup rings 28, which assists the system 10 with retrievability. In such an exemplary embodiment, the non-expandable portion 76 of the outer backup ring 22 is connected to a sleeve portion 102 of second petal support 100, such as by set screw 110, and the sleeve portion 90 of ramp body 92 moves axially relative to the sleeve portion 102 of the second petal support 100. In an exemplary embodiment, an anchor, such as a packer having slips 104 formed thereon, ramps up an opposite end of the ramp body 92 to anchor the packing system to the casing 12. In an alternative exemplary embodiment, the backup rings 28 may face in the uphole direction, in an opposite direction than the backup rings 26, and employ a mirror image of petal support 18 and angled surface 86 to ramp up and support expanded backup rings 28. Such an embodiment may be applicable to, but not limited to, a system suitable for permanent type equipment.

In an exemplary embodiment, the first petal support 18, ramp body 92, and the backup rings 26, 28 are pinned respectively together with shear screws 106, 108 that are sheared during the setting stages.

While the system 10 can include features such as petal supports keyed to the main body so as to be suitable for permanent type equipment that require milling, and slips that anchor the packer to the casing 12, the system 10 also includes features that assist in the retrievability of the device, thus providing a retrievable tool. It is possible to retract the backup rings 22 and 24 from R2 to R1 to provide the clearance 14, as shown in FIG. 1. Additionally, in one exemplary embodiment, both sets of backup rings 26 and 28 are downwardly facing to assist retrievability. That is, the first ends of the backup rings 26, 28 are respectively closer to the downhole end of the system 10 while the second ends of the backup rings 26, 28 are respectively closer to the uphole end of the system 10, and the first ends have a larger diameter than the second ends. The backup rings 26, 28 face in the same direction such that both sets of backup rings 26, 28 point towards the uphole end of the tubular to assist in retrieving the system 10 from the tubular. Setting and unsetting of the system 10 is thus possible for a plurality of cycles.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An antiextrusion backup system comprising:

a first set of backup rings including an inner expandable backup ring having a first set of slots; and an outer expandable backup ring having a second set of slots, wherein the outer expandable back up ring is rotationally locked to the inner expandable backup ring to prevent an extrusion gap in an expanded condition of the backup rings; and, a second set of backup rings separated from the first set of backup rings by a deformable sealing element, wherein the first set of backup rings is adjacent a first axial end of the deformable sealing element and the second set of backup rings is adjacent a second axial end of the deformable sealing element when in an expanded condition of the first and second set of backup rings, the first and second sets of backup rings operable to prevent extrusion of the deformable sealing element therebetween when expanded, each of the first and second sets of backup rings having a first end and a second end, the first end of each of the first and second sets of backup rings having a larger diameter than the second ends thereof;

wherein the second end of the second set of backup rings is located between the first end of the first set of backup rings and the first end of the second set of backup rings.

2. The antiextrusion backup system of claim 1, wherein the inner expandable backup ring includes first flanges respectively overlapped by the second set of slots and the outer expandable backup ring includes second flanges respectively overlapping the first set of slots.

3. The antiextrusion backup system of claim 2, wherein the second flanges have a substantially triangular cross-section.

4. The antiextrusion backup system of claim 1, wherein the inner and outer expandable backup rings each include a hinge area between a first end and a second end of the respective rings.

5. The antiextrusion backup system of claim 4, wherein the inner and outer expandable backup rings are rotationally locked together at a non-expandable portion between the hinge area and the second end.

6. The antiextrusion backup system of claim 4, wherein the inner expandable backup ring has a substantially frusto-conical shape from the hinge area to the first end, with a larger radial dimension in the expanded condition than in a non-expanded condition.

7. The antiextrusion backup system of claim 1, wherein the inner and outer expandable backup rings are nested together.

8. The antiextrusion backup system of claim 1, wherein the first and second sets of backup rings including substantially conically shaped portions, the substantially conically shaped portions of the first set of backup rings facing in a same axial direction as the substantially conically shaped portions of the second set of backup rings to assist in retrievability of the first and second sets of backup rings from a tubular.

9. The antiextrusion backup system of claim 8, wherein the first and second sets of backup rings are arranged to be maintained in the expanded condition and prevented from collapsing inwardly when the extrusion gap is to be prevented.

10. A packing element system comprising:

first and second sets of backup rings, each set of backup rings including:

an inner expandable backup ring having a first set of slots; and an outer expandable backup ring having a second set of slots, wherein the outer expandable back up ring is rotationally locked to the inner expandable backup ring to prevent an extrusion gap in an expanded condition of the backup rings; and, a deformable element positioned between the first and second sets of backup rings, wherein the first set of backup rings is adjacent a first axial end of the deformable sealing element and the second set of backup rings is adjacent a second axial end of the deformable sealing element when in an expanded condition of the first and second set of backup rings, the first and second sets of backup rings operable to prevent extrusion of the deformable sealing element therebetween when expanded, wherein the first set of backup rings face in a same axial direction as the second set of backup rings such that each of the first and second sets of backup rings having a first end and a second end, the first end of each of the first and second sets of backup rings having a larger diameter than the second ends thereof, and wherein the second end of the second set of backup rings is located between the first end of the first set of backup rings and the first end of the second set of backup rings.

11. The packing element system of claim 10, further comprising a first petal support between the deformable element and the first set of backup rings, and a second petal support between the deformable element and the second set of backup rings, wherein the first petal support contacts an inner surface of the inner expandable backup ring in the first set of backup rings and the second petal support contacts an outer surface of the outer expandable backup ring in the second set of backup rings.

12. The packing element system of claim 11, further comprising a ramp body having a ramp surface contacting an inner surface of the inner expandable backup ring in the second set of backup rings, wherein the first petal support includes a ramp surface contacting the inner surface of the inner expandable backup ring in the first set of backup rings.

13. The packing element system of claim 12, wherein the second set of backup rings is supported by contact faces between the second petal support and the ramp body in a set condition of the packing element system.

14. The packing element system of claim 10, wherein the outer expandable backup ring in each set of backup rings include flanges separated by the second set of slots, wherein the flanges have a substantially triangular cross-section.

15. The packing element system of claim 14, wherein the outer expandable backup ring has a substantially cylindrical shape along a first side of the substantially triangular cross-section of the flanges during a non-expanded condition of the backup rings, and a second side of the substantially triangular cross-section of the flanges engages an outer surface of the inner expandable backup rings.

16. The packing element system of claim 15, wherein a third side of the substantially triangular cross-section of the flanges of the outer expandable backup ring in the second set of backup rings is spaced from a petal support in the non-expanded condition and is supported by the petal support in the expanded condition.

17. The packing element system of claim 15, wherein the outer expandable backup ring has a substantially frusto-conical shape along a third side of the substantially triangular cross-section of the flanges.

18. The packing element system of claim 10, wherein the inner and outer expandable backup rings each include a hinge area between a first end and a second end, and are rotationally locked together at a non-expandable portion between the hinge area and the second end.

19. The packing element system of claim 18, wherein the inner expandable backup rings each have a substantially frusto-conical shape with a larger radial dimension in the expanded condition than in a non-expanded condition.

20. The packing element system of claim 10, wherein the first and second sets of backup rings are both arranged to point in an uphole direction in a non-expanded condition to assist in retrievability of the packing element system.

21. The packing element system of claim 20, wherein the first and second sets of backup rings are arranged to be maintained in the expanded condition and prevented from collapsing inwardly when the extrusion gap is to be prevented.

22. The packing element system of claim 10, wherein the second ends of each of the first and second backup rings are positioned closer to an uphole end of the packing element system than the first ends thereof.

23. A method for operating within a tubular, the method comprising:

compressing a packing element system, the system including first and second sets of backup rings, the first set of backup rings facing in a same axial direction as the second set of backup rings such that each of the first and second sets of backup rings having a first end and a second end, the first end of each of the first and second sets of backup rings having a larger diameter than the second ends thereof, and wherein the second end of the second set of backup rings is located between the first end of the first set of backup rings and the first end of the second set of backup rings, each set of backup rings including an inner expandable backup ring having a first set of slots and an outer expandable backup ring having a second set of slots, the outer expandable back up ring rotationally locked to the inner expandable backup ring, and a deformable element positioned between the first and second sets of backup rings, wherein the first set of backup rings is adjacent a first axial end of the deformable sealing element and the second set of backup rings is adjacent a second axial end of the deformable sealing element when in an expanded condition of the first and second set of backup rings;

deforming the deformable element into contact with an inner surface of the tubular;

engaging the first and second sets of backup rings with the inner surface of the tubular by expanding the first and second sets of backup rings; and preventing extrusion of the deformable element through the backup rings by overlapping the slots of the inner backup rings with flanges of the outer backup rings and flanges of the inner backup rings with the slots of the outer backup rings.

24. The method of claim 23, further comprising removing the packing element system from the tubular by collapsing the backup rings to provide a clearance between the backup rings and the tubular and pointing a conical shape of the first and second sets of backup rings towards an uphole end of the tubular.

25. The packing element system of claim 23, wherein the second ends of each of the first and second backup rings are positioned closer to an uphole end of the packing element system than the first ends thereof.

26. The method of claim 23, further comprising maintaining the first and second sets of backup rings in the expanded condition and preventing them from collapsing inwardly when extrusion of the deformable element is to be prevented.

27. A packing element system comprising:

first and second expandable backup rings each having a first expandable end and a second end, the second end having a smaller diameter than the first expandable end, wherein the second end of the second set of backup rings is located between the first end of the first set of backup rings and the first end of the second set of backup rings; and, a deformable element positioned between the first and second expandable backup rings, the deformable element deformable between the first and second expandable backup rings in an expanded condition of the first and second expandable backup rings;

wherein the first set of backup rings is adjacent a first axial end of the deformable sealing element and the second set of backup rings is adjacent a second axial end of the deformable sealing element when in an expanded condition of the first and second set of backup rings, the first and second sets of backup rings operable to prevent extrusion of the deformable sealing element therebetween when expanded; and wherein the first end of the first expandable backup ring is located between the second end of the first expandable backup ring and the deformable element, and the second end of the second expandable backup ring is located between the deformable element and the first end of the second expandable backup ring to assist in retrievability of the packing element system from a tubular.

* * * * *